US011699327B2

(12) United States Patent
Cohn et al.

(10) Patent No.: US 11,699,327 B2
(45) Date of Patent: Jul. 11, 2023

(54) GAMING MACHINE AND METHOD WITH PERSISTENT AWARD MODIFIER TRIGGERED AND MODIFIED BY APPEARANCE OF A CATALYST SYMBOL

(71) Applicant: LNW Gaming, Inc., Las Vegas, NV (US)

(72) Inventors: Kimberly Cohn, Las Vegas, NV (US); George Bouvier, Henderson, NV (US); Kenneth Shawn Soong, Henderson, NV (US)

(73) Assignee: LNW Gaming, Inc., Las Vegas, NV (US)

( * ) Notice: Subject to any disclaimer, the term of this patent is extended or adjusted under 35 U.S.C. 154(b) by 0 days.

(21) Appl. No.: 17/528,395

(22) Filed: Nov. 17, 2021

(65) Prior Publication Data

US 2023/0154285 A1 May 18, 2023

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
CPC .. G07F 17/3213; G07F 17/3267; G07F 17/34; G07F 17/323; G07F 17/3251; G07F 17/3244
See application file for complete search history.

(56) References Cited

U.S. PATENT DOCUMENTS

| | | | |
|---|---|---|---|
| 3,733,075 | A | 5/1973 | Hooker et al. |
| 4,198,052 | A | 4/1980 | Gauselmann |
| 4,732,386 | A | 3/1988 | Rayfiel |
| 5,100,137 | A | 3/1992 | Fulton |
| 5,152,529 | A | 10/1992 | Okada |
| 5,205,555 | A | 4/1993 | Hamano |

(Continued)

FOREIGN PATENT DOCUMENTS

| | | | |
|---|---|---|---|
| AU | 2001055957 | A1 | 3/2002 |
| AU | 2013251288 | A1 | 5/2014 |

(Continued)

OTHER PUBLICATIONS

Ancient Arcadia game brochure. Copyright 2011 IGT.

(Continued)

*Primary Examiner* — Justin L Myhr

(57) ABSTRACT

There is provided a gaming system, gaming machine, and method that utilize an electronic display device configured to display a plurality of symbol-bearing reels and an indicator bearing a pay multiplier. For each spin outcome, the reels are spun and stopped to land symbols in an array. In response to the landed symbols including a catalyst symbol, the values on any value-bearing symbols in the array are multiplied by the pay multiplier and awarded, and the pay multiplier is then modified for a subsequent spin outcome(s) based on the type, e.g., color, of the catalyst symbol. In response to the landed symbols not including the catalyst symbol, no awards are provided for any value-bearing symbols in the array, and the pay multiplier stays the same for a subsequent spin outcome(s) until a catalyst symbol lands in the array.

19 Claims, 4 Drawing Sheets

(56) References Cited

U.S. PATENT DOCUMENTS 5,342,047 A 8/1994 Heidel et al.
5,356,140 A 10/1994 Dabrowski et al.
5,393,061 A 2/1995 Manship et al.
5,395,111 A 3/1995 Inoue
5,431,408 A 7/1995 Adams
5,511,781 A 4/1996 Wood et al.
5,618,232 A 4/1997 Martin
5,695,188 A 12/1997 Ishibashi
5,704,835 A 1/1998 Dietz
5,722,891 A 3/1998 Inoue
5,752,881 A 5/1998 Inoue
5,766,074 A 6/1998 Cannon et al.
5,788,573 A 8/1998 Baerlocher et al.
5,807,177 A 9/1998 Takemoto et al.
5,810,665 A 9/1998 Takemoto et al.
5,833,537 A 11/1998 Barrie
5,848,932 A 12/1998 Adams
5,855,515 A 1/1999 Pease et al.
5,876,284 A 3/1999 Acres et al.
5,882,259 A 3/1999 Holmes et al.
5,882,261 A 3/1999 Adams
5,890,962 A 4/1999 Takemoto
5,911,418 A 6/1999 Adams
5,947,820 A 9/1999 Morro et al.
5,951,397 A 9/1999 Dickinson
5,988,638 A 11/1999 Rodesch et al.
6,004,207 A 12/1999 Wilson et al.
6,027,115 A 2/2000 Griswold et al.
6,033,307 A 3/2000 Vancura
6,048,269 A 4/2000 Burns et al.
6,050,895 A 4/2000 Luciano et al.
6,056,642 A 5/2000 Bennett
6,089,976 A 7/2000 Schneider et al.
6,089,977 A 7/2000 Bennett
6,102,798 A 8/2000 Bennett
6,120,031 A 9/2000 Adams
6,142,873 A 11/2000 Weiss et al.
6,159,097 A 12/2000 Gura
6,162,121 A 12/2000 Morro et al.
6,168,520 B1 1/2001 Baerlocher et al.
6,186,894 B1 2/2001 Mayeroff
6,203,429 B1 3/2001 Demar et al.
6,213,875 B1 4/2001 Suzuki
6,224,482 B1 5/2001 Bennett
6,224,483 B1 5/2001 Mayeroff
6,224,484 B1 5/2001 Okuda et al.
6,227,971 B1 5/2001 Weiss
6,241,607 B1 6/2001 Payne et al.
6,251,013 B1 6/2001 Bennett
6,270,411 B1 8/2001 Gura et al.
6,270,412 B1 8/2001 Crawford et al.
6,290,600 B1 9/2001 Glasson
6,309,300 B1 10/2001 Glavich
6,319,124 B1 11/2001 Baerlocher et al.
6,375,567 B1 4/2002 Acres
6,375,570 B1 4/2002 Poole
6,413,162 B1 7/2002 Baerlocher et al.
6,481,713 B2 11/2002 Perrie et al.
6,517,432 B1 2/2003 Jaffe
6,537,150 B1 3/2003 Luciano et al.
6,544,120 B2 4/2003 Ainsworth
6,547,242 B1 4/2003 Sugiyama et al.
6,551,187 B1 4/2003 Jaffe
6,554,704 B2 4/2003 Nicastro et al.
6,558,254 B2 5/2003 Baelocher et al.
6,561,900 B1 5/2003 Baerlocher et al.
6,561,904 B2 5/2003 Locke et al.
6,565,434 B1 5/2003 Acres
6,641,477 B1 11/2003 Dietz
6,652,378 B2 11/2003 Cannon et al.
6,656,040 B1 12/2003 Brosnan et al.
6,657,923 B2 12/2003 Laughlin
6,692,356 B2 2/2004 Baerlocher et al.
6,702,675 B2 3/2004 Poole et al.
6,731,313 B1 5/2004 Kaminkow
6,786,818 B1 9/2004 Rothschild et al.
6,832,957 B2 12/2004 Falconer
6,837,790 B1 1/2005 Kaminkow
6,869,360 B2 3/2005 Marks et al.
6,896,617 B2 5/2005 Daly
6,910,962 B2 6/2005 Marks et al.
6,916,243 B2 7/2005 Yoshida
6,918,834 B2 7/2005 Vancura
6,926,609 B2 8/2005 Martin
6,960,134 B2 11/2005 Hartl et al.
7,018,293 B2 3/2006 Brown et al.
7,029,395 B1 4/2006 Baerlocher
7,029,396 B2 4/2006 Jaffe et al.
7,121,945 B2 10/2006 Suganuma et al.
7,147,559 B2 12/2006 Englman
7,156,740 B2 1/2007 Kaminkow
7,179,169 B2 2/2007 Beaulieu et al.
7,252,591 B2 8/2007 Van Asdale
7,316,613 B2 1/2008 Luccesi et al.
7,371,170 B2 5/2008 Cregan et al.
7,377,850 B2 5/2008 Shackelford et al.
7,431,646 B2 10/2008 Jackson
7,452,276 B2 11/2008 Loose et al.
7,458,890 B2 12/2008 Loose et al.
7,488,252 B2 2/2009 Griswold et al.
7,503,847 B2 3/2009 Baerlocher
7,526,736 B2 4/2009 Kaminkow et al.
7,553,231 B2 6/2009 Rodgers et al.
7,578,735 B2 8/2009 Frizzell et al.
7,601,062 B2 10/2009 Cole et al.
7,604,538 B2 10/2009 Pacey
7,618,319 B2 11/2009 Casey et al.
7,625,278 B2 12/2009 Paulsen et al.
7,654,895 B2 2/2010 Pacey
7,654,899 B2 2/2010 Durham et al.
7,699,699 B2 4/2010 Gilliland et al.
7,704,141 B1 * 4/2010 Marks ..... G07F 17/34 463/16
7,744,460 B2 6/2010 Walker et al.
7,785,191 B2 8/2010 Marks et al.
7,789,744 B2 9/2010 Fiden
7,841,934 B2 11/2010 Gauselmann
7,980,936 B2 7/2011 Mead
8,021,223 B2 9/2011 Rose
8,021,225 B2 9/2011 Okada
8,066,563 B1 11/2011 Schultz et al.
8,083,581 B2 12/2011 Marks et al.
8,105,145 B2 1/2012 Jaffe
8,105,151 B2 1/2012 Caputo et al.
8,113,940 B2 2/2012 Hornik
8,147,322 B2 4/2012 Walker et al.
8,162,740 B2 4/2012 Aoki
8,162,741 B2 4/2012 Wadleigh et al.
8,192,275 B2 6/2012 Aoki et al.
8,246,442 B1 8/2012 Barrie
8,272,938 B2 9/2012 Gilmore et al.
8,287,357 B2 10/2012 Evans
8,323,091 B2 12/2012 Frank et al.
8,357,041 B1 1/2013 Saunders
8,360,851 B2 1/2013 Aoki et al.
8,366,538 B1 2/2013 Saunders et al.
8,371,930 B1 2/2013 Saunders et al.
8,388,432 B2 3/2013 Mattice et al.
8,414,380 B2 4/2013 Saunders et al.
8,465,358 B2 6/2013 Kemper
8,496,522 B2 7/2013 Caputo et al.
8,512,121 B2 8/2013 Macvittie et al.
8,512,124 B2 8/2013 Bramble et al.
8,512,138 B2 8/2013 Saunders
8,523,659 B2 9/2013 Evans
8,574,059 B2 11/2013 Rodgers et al.
8,602,868 B2 12/2013 Johnson et al.
8,608,545 B2 12/2013 Arora et al.
8,662,986 B2 3/2014 Rodgers et al.
8,678,908 B2 3/2014 Nicely
8,690,660 B2 4/2014 Saunders et al.
8,696,434 B2 4/2014 Tsukahara
8,702,487 B2 4/2014 Thomas
8,790,169 B2 7/2014 Saunders

(56) References Cited

U.S. PATENT DOCUMENTS 8,795,059 B2 8/2014 Aoki et al.
8,821,254 B2 9/2014 Tsukahara
8,834,258 B2 9/2014 Gobe et al.
8,851,974 B2 10/2014 Caputo et al.
8,870,642 B2 10/2014 Leupp et al.
8,882,578 B2 11/2014 Saunders
8,961,291 B2 2/2015 Dias Pires et al.
9,005,022 B2 4/2015 Saunders
9,011,233 B2 4/2015 Ryan
9,098,847 B2 8/2015 Basallo et al.
9,098,973 B2 8/2015 Basallo et al.
9,147,321 B2 9/2015 Moody
9,165,433 B2 10/2015 Caputo
9,177,447 B2 11/2015 Zoltewicz et al.
9,202,345 B2 12/2015 Zoltewicz et al.
9,214,011 B2 12/2015 Wei et al.
9,230,410 B2 1/2016 Saunders et al.
9,245,421 B2 1/2016 Saunders et al.
9,251,667 B2 2/2016 Marks et al.
9,257,017 B2 2/2016 Saunders et al.
9,262,895 B2 2/2016 Rodgers et al.
9,275,524 B2 3/2016 Nicely
9,299,224 B2 3/2016 Leupp
9,311,781 B2 4/2016 Edwards
9,349,251 B2 5/2016 Caputo et al.
9,355,528 B2 5/2016 Nicely
9,418,521 B1 8/2016 Henrick et al.
9,424,720 B2 8/2016 Suda
9,430,900 B2 8/2016 Zoltewicz et al.
9,466,169 B2 10/2016 Basallo et al.
9,474,972 B2 10/2016 Lenger
9,495,839 B2 11/2016 Aoki et al.
9,595,157 B2 3/2017 Rasmussen et al.
9,633,506 B2 4/2017 Basallo et al.
9,704,342 B2 7/2017 Aoki et al.
9,928,691 B2 3/2018 Olive
10,013,855 B2 7/2018 Nakamura
10,037,651 B2 7/2018 You et al.
10,043,350 B2 8/2018 Gomez et al.
10,062,237 B2 8/2018 Devine et al.
10,204,473 B2 2/2019 Lenger
10,242,533 B2 3/2019 Okada et al.
10,339,761 B2 7/2019 Olive
10,366,575 B2 7/2019 Visser
10,388,112 B2 8/2019 You et al.
10,410,472 B2 9/2019 Moody
10,417,877 B2 9/2019 Gomez et al.
10,475,294 B2 11/2019 Gomez et al.
10,497,203 B2 12/2019 Elmqvist
10,672,220 B2 6/2020 Lenger
10,706,664 B2 7/2020 Boese et al.
10,726,676 B2 7/2020 You et al.
10,769,888 B2 9/2020 You et al.
10,839,648 B2 11/2020 Okada et al.
10,957,161 B2 3/2021 Chesworth et al.
11,017,638 B2 5/2021 Chesworth et al.
2001/0021666 A1 9/2001 Yoshida et al.
2002/0016200 A1 2/2002 Baerlocher et al.
2002/0045474 A1 4/2002 Singer et al.
2002/0119818 A1 8/2002 Savio et al.
2002/0155881 A1 10/2002 Yoshida
2002/0183105 A1 12/2002 Cannon et al.
2003/0017865 A1 1/2003 Beaulieu et al.
2003/0027619 A1 2/2003 Nicastro, Sr.
2003/0035346 A1 2/2003 Laughlin
2003/0064782 A1 4/2003 Beaulieu et al.
2003/0064801 A1 4/2003 Breckner et al.
2003/0064802 A1 4/2003 Rodgers et al.
2003/0069063 A1 4/2003 Bilyeu et al.
2003/0130034 A1 7/2003 Suganuma et al.
2003/0157980 A1 8/2003 Loose et al.
2003/0216165 A1 11/2003 Singer et al.
2004/0012145 A1 1/2004 Inoue
2004/0023714 A1 2/2004 Asdale
2004/0043815 A1 3/2004 Kaminkow
2004/0048646 A1 3/2004 Visocnik
2004/0092315 A1 5/2004 Boyd et al.
2004/0137982 A1 7/2004 Cuddy et al.
2004/0171417 A1 9/2004 Beaulieu et al.
2004/0198489 A1 10/2004 Kaminkow et al.
2005/0054442 A1 3/2005 Anderson et al.
2005/0130731 A1 6/2005 Englman et al.
2005/0159208 A1 7/2005 Pacey
2006/0009286 A1 1/2006 Durham et al.
2006/0063588 A1 3/2006 Poole
2006/0111173 A1 5/2006 Yang
2006/0121978 A1* 6/2006 Hornik ..... G07F 17/3244 463/20
2006/0142080 A1 6/2006 Enzminger
2006/0189369 A1 8/2006 Taylor
2006/0205469 A1 9/2006 Schultz et al.
2006/0247002 A1 11/2006 Yoshimi et al.
2007/0060248 A1 3/2007 Rodgers et al.
2007/0060255 A1 3/2007 Baerlocher et al.
2007/0060275 A1 3/2007 Gilmore et al.
2007/0129135 A1 6/2007 Marks et al.
2007/0149267 A1 6/2007 Ross et al.
2007/0281784 A1 12/2007 Seelig et al.
2007/0287529 A1 12/2007 Kojima
2008/0003278 A1 1/2008 Mondelo
2008/0004532 A1 1/2008 Rubey et al.
2008/0032784 A1 2/2008 Englman
2008/0045298 A1 2/2008 Yoshizawa
2008/0045320 A1 2/2008 Kato
2008/0108408 A1 5/2008 Wolf
2008/0108411 A1 5/2008 Jensen et al.
2008/0108422 A1 5/2008 Hedrick et al.
2008/0108431 A1 5/2008 Cuddy et al.
2008/0132321 A1 6/2008 Pau
2008/0182647 A1 7/2008 Brunet De Courssou et al.
2008/0274789 A1 11/2008 Singer et al.
2009/0036208 A1 2/2009 Pennington et al.
2009/0156287 A1 6/2009 Baumgartner
2009/0181755 A1 7/2009 Gagner et al.
2009/0239634 A1 9/2009 Nguyen
2009/0291741 A1 11/2009 Schofield
2010/0075737 A1 3/2010 Bluemel
2010/0113133 A1 5/2010 Leupp
2010/0167815 A1 7/2010 Gagner et al.
2010/0203948 A1 8/2010 Falciglia, Sr.
2010/0210343 A1 8/2010 Englman et al.
2010/0234092 A1 9/2010 Gomez et al.
2010/0304832 A1 12/2010 Kup-Ferroth
2011/0244943 A1 10/2011 Milford et al.
2011/0300937 A1 12/2011 Crowder, Jr. et al.
2012/0015707 A1 1/2012 Hornik et al.
2012/0077564 A1 3/2012 Collette et al.
2012/0094738 A1 4/2012 Aoki et al.
2012/0122532 A1 5/2012 Berman et al.
2012/0178517 A1 7/2012 Montenegro et al.
2012/0220360 A1 8/2012 Kelly et al.
2013/0065663 A1 3/2013 Johnson et al.
2013/0102375 A1 4/2013 Aoki et al.
2013/0260861 A1 10/2013 Vann et al.
2014/0014186 A1 1/2014 Bhattacharya et al.
2014/0024429 A1 1/2014 Aoki et al.
2014/0051496 A1* 2/2014 Meyer ..... G07F 17/3267 463/20
2014/0141860 A1 5/2014 Meyer
2014/0179396 A1 6/2014 Aoki et al.
2014/0274292 A1 9/2014 Suda
2014/0323198 A1 10/2014 Tuck
2015/0031437 A1 1/2015 Gomez et al.
2015/0170462 A1 6/2015 Berman et al.
2015/0206386 A1 7/2015 Jaffe et al.
2015/0269809 A1 9/2015 Smith
2015/0287269 A1 10/2015 Berman
2015/0356833 A1 12/2015 Aoki et al.
2015/0379831 A1 12/2015 Lee et al.
2016/0042597 A1 2/2016 Olive
2016/0155303 A1 6/2016 Aoki et al.
2017/0154498 A1 6/2017 Olive
2017/0372558 A1 12/2017 You et al.
2018/0130303 A1 5/2018 Lamb

(56) References Cited

U.S. PATENT DOCUMENTS

| | | | | |
|---|---|---|---|---|
| 2018/0268655 | A1 | 9/2018 | Olive | |
| 2018/0268659 | A1 | 9/2018 | Chesworth et al. | |
| 2019/0102992 | A1 | 4/2019 | You et al. | |
| 2019/0236905 | A1 | 8/2019 | Washington et al. | |
| 2020/0279457 | A1* | 9/2020 | Chesworth | G07F 17/3251 |
| 2020/0312083 | A1* | 10/2020 | Halvorson | G07F 17/3213 |
| 2021/0065503 | A1* | 3/2021 | Englman | G07F 17/3262 |
| 2021/0097812 | A1* | 4/2021 | Malik | G07F 17/3225 |
| 2021/0304565 | A1* | 9/2021 | Marks | G07F 17/3267 |

FOREIGN PATENT DOCUMENTS

| | | | |
|---|---|---|---|
| AU | 2014202042 | A1 | 5/2014 |
| AU | 2015210489 | A1 | 2/2016 |
| GB | 2097160 | A | 10/1982 |
| GB | 2097160 | B | 5/1984 |
| GB | 2144568 | A | 3/1985 |
| GB | 2144568 | B | 9/1985 |
| GB | 2251112 | A | 6/1992 |

OTHER PUBLICATIONS

Flying Carpet game brochure, Copyright 2008 Bally.
Golden Knight game brochure. Copyright 2010 IGT.
Sultan of Mars game brochure, Copyright 2011 IGT.
The Amulet and the Charm game brochure, Copyright 2011 IGT.

* cited by examiner

GAMING MACHINE AND METHOD WITH PERSISTENT AWARD MODIFIER TRIGGERED AND MODIFIED BY APPEARANCE OF A CATALYST SYMBOL

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2021, SG Gaming, Inc.

FIELD OF THE INVENTION

The present invention relates to a technological improvement to gaming systems, gaming machines, and methods and, more particularly, to new and improved animations in connection with a symbol array persistence feature.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

Another significant technical challenge is to provide a new and improved level of game play that uses new and improved gaming apparatus animations. Improved animations represent improvements to the underlying technology or technical field of gaming apparatus and, at the same time, have the effect of encouraging prolonged and frequent player participation.

SUMMARY OF THE INVENTION

According to an embodiment of the present invention, there is provided a gaming system, gaming machine, and method that utilize an electronic display device configured to display a plurality of symbol-bearing reels and an indicator bearing a pay multiplier. For each spin outcome, the reels are spun and stopped to land symbols in an array. In response to the landed symbols including a catalyst symbol, the values on any value-bearing symbols in the array are multiplied by the pay multiplier and awarded, and the pay multiplier is then modified for a subsequent spin outcome(s) based on the type, e.g., color, of the catalyst symbol. In response to the landed symbols not including the catalyst symbol, no awards are provided for any value-bearing symbols in the array, and the pay multiplier stays the same for subsequent spin outcome(s) until a catalyst symbol lands in the array. Whether or not a catalyst symbol appears in the spin outcome, the pay multiplier multiplies other pays, e.g., standard pays, in the spin outcome.

Additional aspects of the invention will be apparent to those of ordinary skill in the art in view of the detailed description of various embodiments, which is made with reference to the drawings, a brief description of which is provided below.

Figure 1:
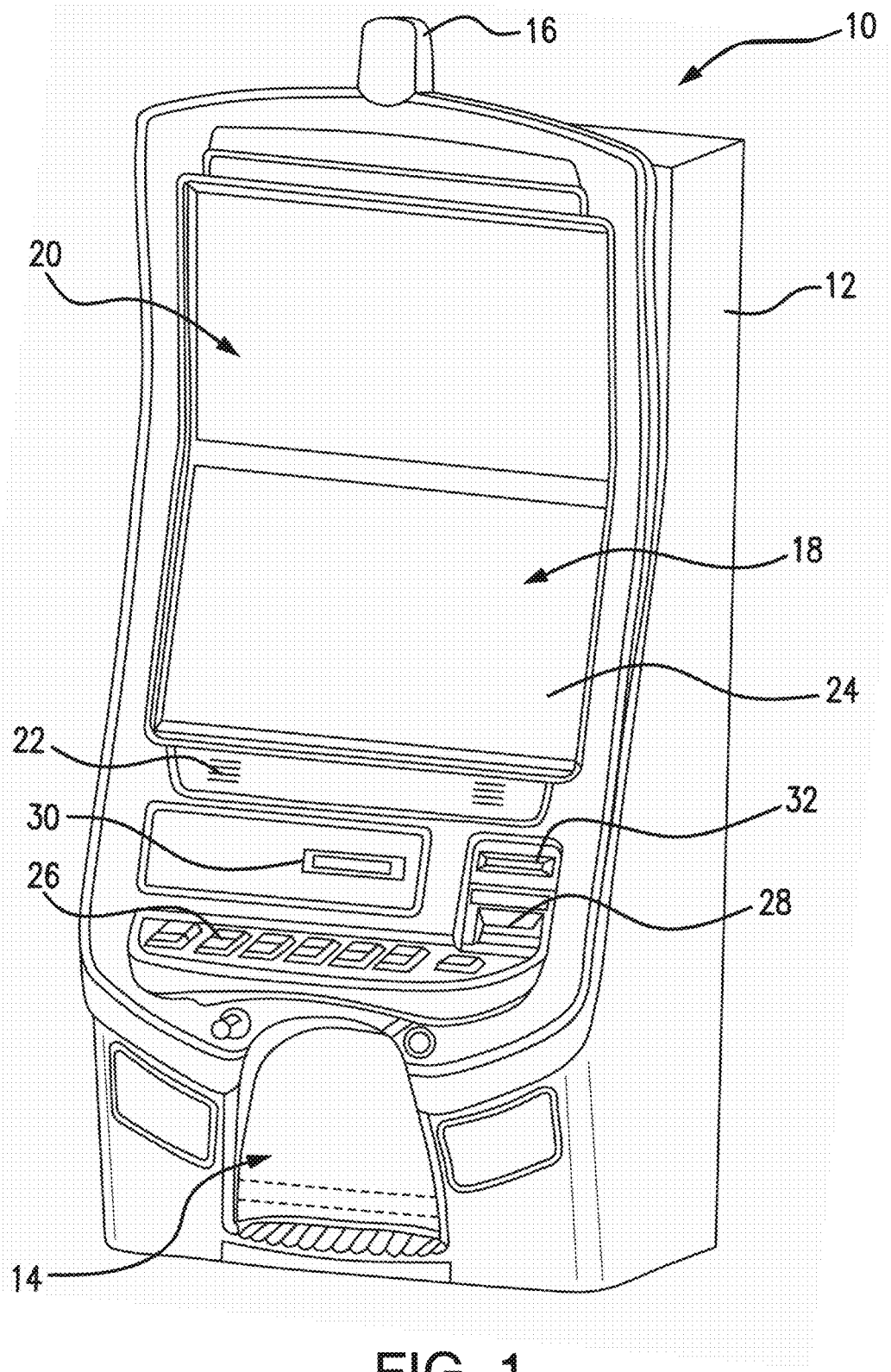
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 200 (see FIG. 4). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 200 (see FIG. 4), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
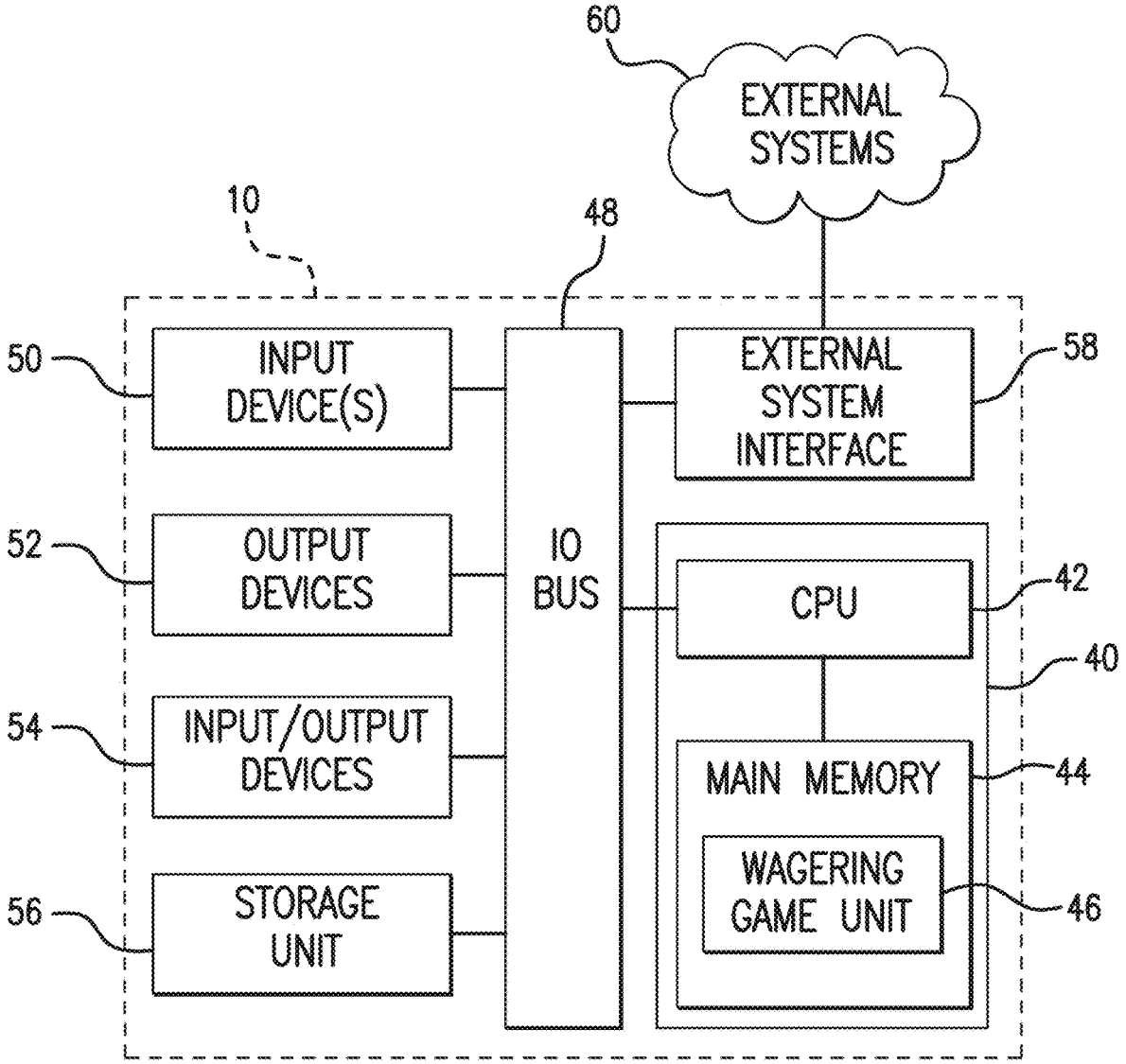
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RP signals (e.g, Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player. Accordingly, the RNG cannot be carried out manually by a human and is integral to operating the game.

The gaming machine 10 may be used to play central determination games, such as electronic pull-tab and bingo games. In an electronic pull-tab game, the RING is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin" touch key or button, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 3:
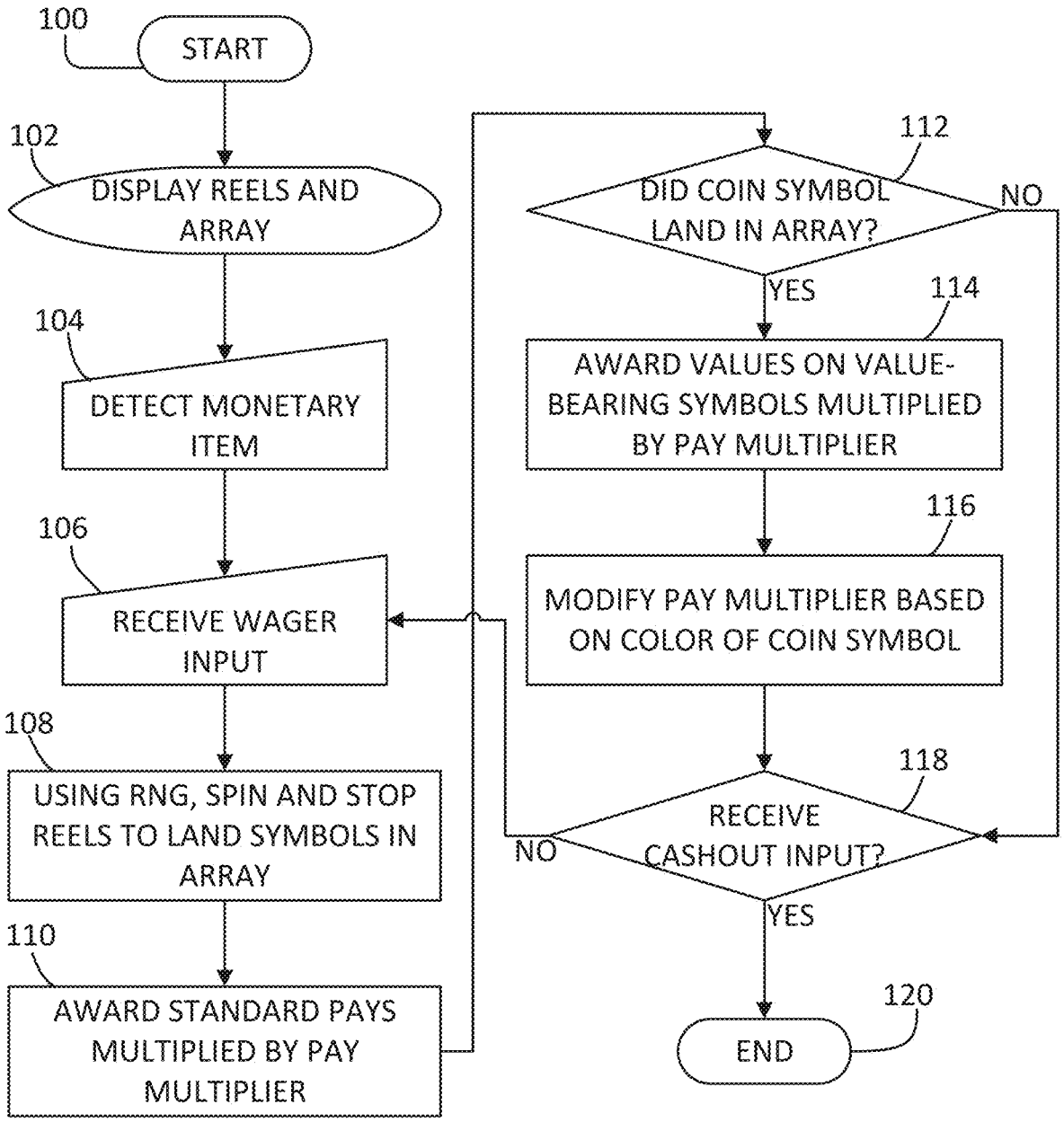
FIG. 3 is a flowchart for a data processing method that corresponds to instructions executed by a controller, according to an embodiment of the present invention.

Referring now to FIG. 3, there is shown a flowchart representing one data processing method corresponding to at least some instructions stored and executed by the game-logic circuitry 40 in FIG. 2 to perform operations according to an embodiment of the present invention.

The data processing method commences at step 100. At step 102, the game-logic circuitry directs an electronic display device (e.g., video display) of the gaming machine to display a plurality of symbol-bearing reels and an array of symbol positions. The array of symbol positions comprises a plurality of rows and columns. The rows of the array are oriented in a horizontal direction, and the columns of the array are oriented in a generally vertical direction. Alternatively, the "rows" of the array may be oriented in a vertical direction, and the "columns" of the array may be oriented in a horizontal direction. The symbol positions in each row of the array are horizontally aligned with each other, and the symbol positions in each column of the array are vertically aligned with each other. The reels may be associated with the respective columns of the array such that the reels spin vertically and each reel populates a respective column. The reel spin is animated by depicting symbol-bearing strips moving vertically across the display and synchronously updating the symbols visible on each strip as the strip moves across the display. In another embodiment, the reels may be associated with the respective rows of the array such that the reels spin horizontally and each reel populates a respective row. In yet another embodiment, the reels may be associated with respective individual symbol positions of the array such that each reel populates only its respective symbol position. In the example shown in FIG. 4, the electronic display device displays five symbol-bearing reels 212, 214, 216, 218, 220 arranged from left to right and associated with respective columns of a 3×5 array 210 that includes three rows and five columns.

Figure 4:
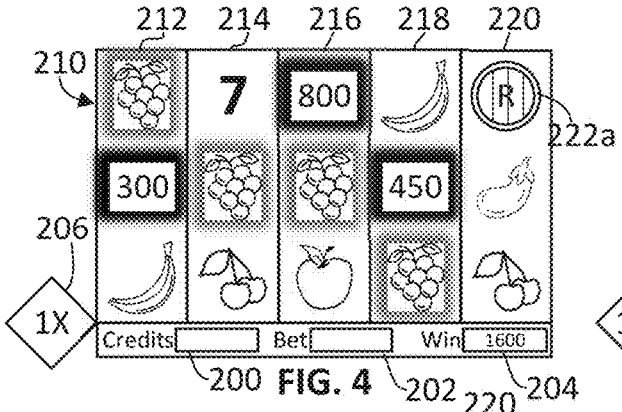
FIGS. 4 through 11 depict an illustrative series of game images that illustrate aspects of the data processing method.

At step 104, the game-logic circuitry detects, via at least one of one or more electronic input devices, a physical item associated with a monetary value that establishes a credit balance. As shown in FIG. 4, the credit balance may be shown on a credit meter 200 of the gaming machine.

At step 106, the game-logic circuitry initiates a wagering game cycle in response to an input indicative of a wager covered by the credit balance. To initiate a spin of the reels, the player may press a "Spin" or "Max Bet" key on a button panel or touch screen. As shown in FIG. 4, the wagered amount may be shown on a bet meter 202 of the gaming machine.

At step 108, using an RNG, the game-logic circuitry spins and stops the plurality of symbol-bearing reels to randomly land symbols from the reels in the array in visual association with one or more paylines (also known as lines, ways, patterns, or arrangements). The game-logic circuitry is configured to evaluate the displayed array of symbols and provides immediate awards and bonus games in accordance with a pay table. The pay table may, for example, include "line pays" and "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly the wagering game may trigger bonus games based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array. Each payline preferably consists of a single symbol position in each column of the array. The number of paylines may be as few as one or as many as possible given each payline consists of a single symbol position in each column of the array. In a 3×5 array with three rows and five columns, the maximum number of such paylines is $3^5$=243 lines. FIG. 4 illustrates the reels 212, 214, 216, 218, 220 after they have been spun and stopped to randomly populate the array 210 with symbols from the reels.

At step 110, the game-logic circuitry awards payouts for any standard pays (e.g., line pays and scatter pays) as determined by the game's pay table. The payouts are multiplied by a spin or pay multiplier (e.g., a multiplier 1× in indicator 206 in FIG. 4). As described below in connection with FIGS. 4-11, the value of the pay multiplier is determined by the color of a most recent COIN symbol to land in the array in a prior spin of the reels. As shown in FIG. 4, the awarded payouts are added to a win meter 204 of the gaming machine.

At step 112, the game-logic circuitry determines whether or not a colored COIN symbol landed in the array. In one embodiment, color COIN symbols only exist on the fifth or rightmost reel 220 (see FIG. 4), If a colored COIN symbol landed in the array at step 112 (e.g., the red COIN symbol 222*a* in FIG. 4), the game-logic circuitry proceeds to steps 114 and 116. At step 114, the game-logic circuitry awards the values borne by any value-bearing symbols (e.g., the three ENVELOPE symbols bearing the credit values 300, 800, and 450 in FIG. 4) multiplied by the pay multiplier (e.g., multiplier 1× in indicator 206 in FIG. 4). The awarded values are added to the win meter 204 shown in FIG. 4. At step 116, the game-logic circuitry modifies the pay multiplier in indicator 206 for the next spin(s) based on the color of the COIN symbol that landed in the array at step 112. The value of the pay multiplier persists (i.e., remains unchanged) until a later spin yields another COIN symbol in the array. In one embodiment, red COIN symbols are associated with an 18X multiplier, blue COIN symbols are associated with an 8× multiplier, and green COIN symbols are associated with a 1× multiplier. Thus, if the landed COIN symbol is red as shown in FIG. 4, the next spin(s) will multiply all resulting pays by 18× until another COIN symbol lands in the array and, once again, changes the multiplier to a value associated with that COIN symbol.

If a colored COIN symbol did not land in the array at step 112, the game-logic circuitry skips steps 114 and 116 and proceeds directly to step 118. At step 118, the game-logic circuitry determines whether or not it has received a cashout input via at least one of the one or more player input devices of the gaming machine. If it has not received a cashout input, the game-logic circuitry waits for the next wager input at step 106. If it has received a cashout input, the game-logic circuitry initiates a payout from the credit balance on the credit meter such as the meter 200 in FIG. 4. The data processing method then ends at step 120.

In accordance with the data processing method in FIG. 3, FIGS. 4 through 11 depict an illustrative series of eight game images associated with a series of eight game cycles. The game images illustrate aspects of the data processing method. Each game image is associated with a different game cycle and represents a wagered spin outcome, i.e., in response to a wager, the reels 212, 214, 216, 218, 220 have been spun and stopped to populate the array 210 with symbols. In the game images, the standard symbols are GRAPE, APPLE, CHERRY, BANANA, WATERMELON, EGGPLANT, and SEVEN; the value-bearing symbols are ENVELOPE (which looks like a rectangle); and a colored COIN symbol landing in the array serves as a catalyst for awarding the ENVELOPE values and changing a pay multiplier in indicator 206 for the next spin(s) based on the color of the COIN symbol. In this illustrated series of game cycles, standard pays occur when three or more matching standard symbols appear on adjacent reels along an active payline starting from the leftmost reel 212.

FIG. 4 depicts a first spin outcome including a standard pay of four GRAPE symbols (assuming the GRAPE symbols are along an active payline); three ENVELOPE symbols bearing values of 300, 800, and 450 credits; and a red COIN symbol 222*a*. The pay multiplier in indicator 206 is currently 1× and was generated in a prior spin outcome (not shown) by a green COIN symbol. The red COIN symbol 222*a* serves as a catalyst for awarding the three ENVELOPE values. If the standard pay for four GRAPE symbols is, for example, 50 credits, then the first spin outcome in FIG. 4 yields a total payout of 1600 credits: the sum of 50 credits (for the four GRAPE symbols) multiplied by 1X (for the pay multiplier), and 1550 credits (for the three ENVELOPE symbols) multiplied by 1X. After this total payout is awarded, the pay multiplier in indicator 206 changes to 18× for the next spin outcome in FIG. 5 because, as described above, the red COIN symbol 222*a* is associated with a pay multiplier of 18×. The pay multiplier will remain at 18× until a future spin outcome includes another COIN symbol.

Figure 5:
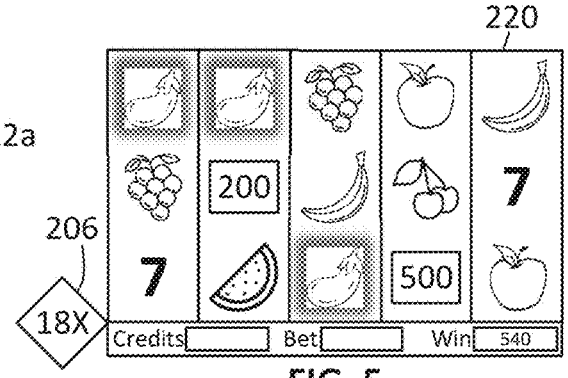

FIG. 5 depicts a second spin outcome including a standard pay of three EGGPLANT symbols (assuming the EGGPLANT symbols are along an active payline); two ENVELOPE symbols bearing values of 200 and 500 credits; and no COIN symbols. The pay multiplier in indicator 206 is now 18× and was generated in the first spin outcome in FIG. 4 by the red COIN symbol 222*a*. If the standard pay for three EGGPLANT symbols is, for example, 30 credits, then the second spin outcome in FIG. 5 yields a total payout of 540 credits: 30 credits (for the three EGGPLANT symbols) multiplied by 18×. Because no COIN symbols landed in the array, the game does not award the values on the two ENVELOPE symbols and keeps the pay multiplier in indicator 206 at 18× for the next spin outcome in FIG. 6.

Figure 6:
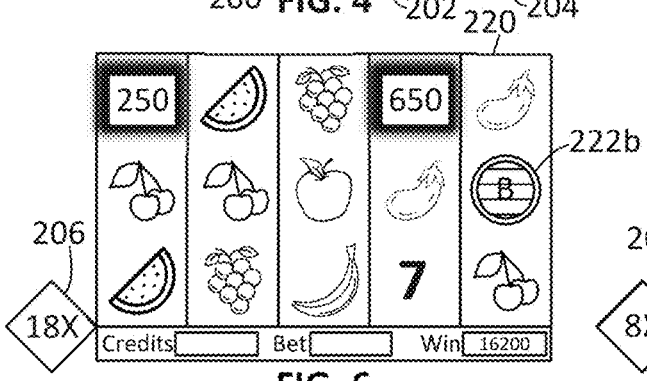

FIG. 6 depicts a third spin outcome including no standard pays; two ENVELOPE symbols bearing values of 250 and 650 credits; and a blue COIN symbol 222*b*. The pay multiplier in indicator 206 is still 18× because the prior spin outcome in FIG. 5 did not include a multiplier-changing COIN symbol. The blue COIN symbol 222*b* serves as a catalyst for awarding the two ENVELOPE values. The third spin outcome in FIG. 6 yields a total payout of 16200 credits: 900 credits (for the two ENVELOPE symbols) multiplied by 18X. After this total payout is awarded, the pay multiplier in indicator 206 changes to 8× for the next spin outcome in FIG. 7 because, as described above, the blue COIN symbol 222*b* is associated with a pay multiplier of 8×. The pay multiplier will remain at 8× until a future spin outcome includes another COIN symbol.

Figure 7:
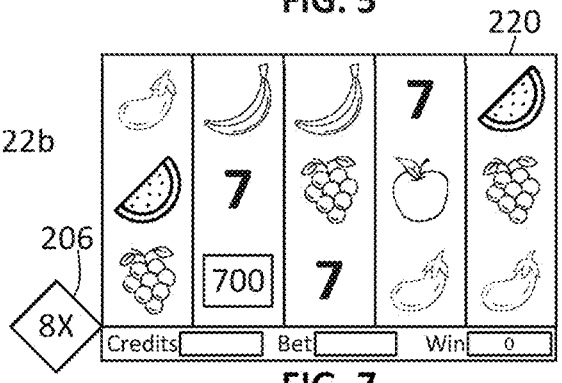

FIG. 7 depicts a fourth spin outcome including no standard pays; one ENVELOPE symbol bearing a value of 700 credits; and no COIN symbols. The pay multiplier in indicator 206 is now 8× and was generated in the third spin outcome in FIG. 6 by the blue COIN symbol 222*h*. The fourth spin outcome yields no payouts. Because no COIN symbols landed in the array, the game does not award the value on the one ENVELOPE symbol and keeps the pay multiplier in indicator 206 at 8× for the next spin outcome in FIG. 8.

Figure 8:
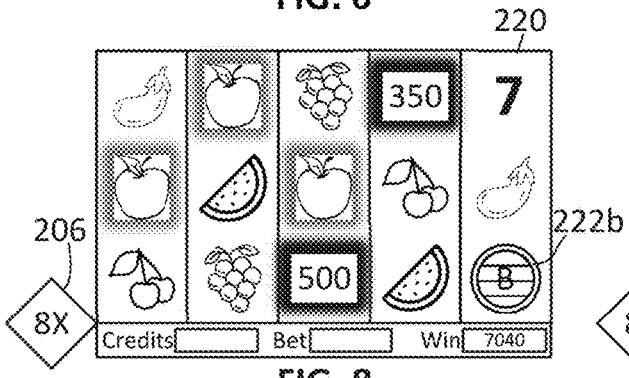

FIG. 8 depicts a fifth spin outcome including a standard pay of three APPLE symbols (assuming the APPLE symbols are along an active payline); two ENVELOPE symbols hearing values of 500 and 350 credits; and a blue COIN symbol 222*b*. The pay multiplier in indicator 206 is still 8× because the prior spin outcome in FIG. 7 did not include a multiplier-changing COIN symbol. The blue COIN symbol 222*b* serves as a catalyst for awarding the two ENVELOPE values. If the standard pay for three APPLE symbols is, for example, 30 credits, then the fifth spin outcome in FIG. 8 yields a total payout of 7040 credits: the sum of 30 credits (for the three APPLE symbols) multiplied by 8× (for the pay multiplier), and 850 credits (for the two ENVELOPE symbols) multiplied by 8×. After this total payout is awarded, the pay multiplier in indicator 206 stays at 8× (or, technically, changes from 8× to 8×) for the next spin outcome in FIG. 9 because the blue COIN symbol 222*b* is associated with a pay multiplier of 8X. The pay multiplier will remain at 8× until a future spin outcome includes another COIN symbol.

Figure 9:
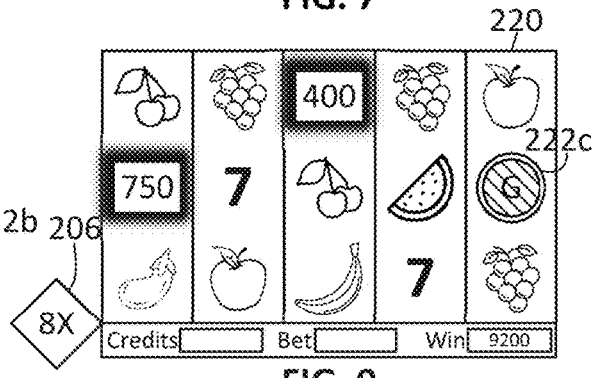

FIG. 9 depicts a sixth spin outcome including no standard pays; two ENVELOPE symbols bearing values of 750 and 400 credits; and a green COIN symbol 222*c*. The pay multiplier in indicator 206 is now 8× and was generated in the fifth spin outcome in FIG. 8 by the blue COIN symbol 222*b*. The green COIN symbol 222*c* serves as a catalyst for awarding the two ENVELOPE values. The sixth spin outcome in FIG. 9 yields a total payout of 9200 credits: 1150 credits (for the two ENVELOPE symbols) multiplied by 8×. After this total payout is awarded, the pay multiplier in indicator 206 changes to 1× for the next spin outcome in FIG. 10 because, as described above, the green COIN symbol 222*c* is associated with the pay multiplier of 1×. The pay multiplier will remain at 1× until a future spin outcome includes another COIN symbol.

Figure 10:
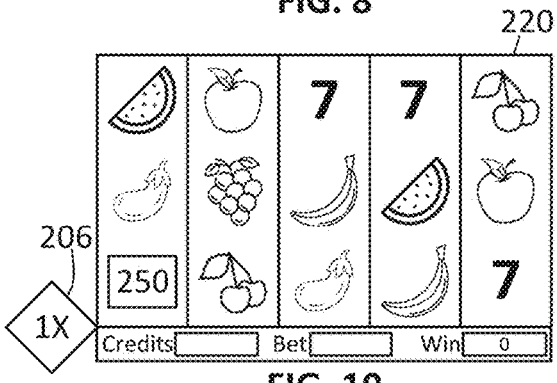

FIG. 10 depicts a seventh spin outcome including no standard pays; one ENVELOPE symbol bearing a value of 250 credits; and no COIN symbols. The pay multiplier in indicator 206 is now 1× and was generated in the sixth spin outcome in FIG. 9 by the green COIN symbol 222*c*. The seventh spin outcome yields no payouts. Because no COIN symbols landed in the array, the game does not award the value on the one ENVELOPE symbol and keeps the pay multiplier in indicator 206 at 1× for the next spin outcome in FIG. 11.

Figure 11:
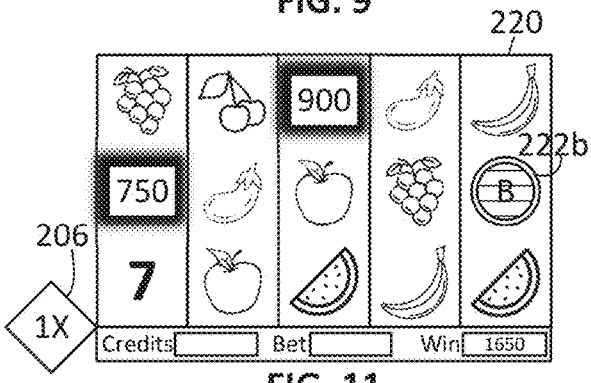

FIG. 11 depicts an eighth spin outcome including no standard pays; two ENVELOPE symbols bearing values of 750 and 900 credits; and a blue COIN symbol 222*b*. The pay multiplier in indicator 206 is still 1× because the prior spin outcome in FIG. 10 did not include a multiplier-changing COIN symbol. The blue COIN symbol 222*b* serves as a catalyst for awarding the two ENVELOPE values. The eighth spin outcome in FIG. 11 yields a total payout of 1650 credits (for the two ENVELOPE symbols) multiplied by 1×. After this total payout is awarded, the pay multiplier in indicator 206 changes to 8× for the next spin outcome (not shown) because the blue COIN symbol 222*b* is associated with a pay multiplier of 8×. The pay multiplier will remain at 8× until a future spin outcome includes another COIN symbol.

The features described above in connection with wagered spin outcomes of the base game may also be used in connection with a bonus game including a series of free spins. In this regard, the bonus game may be constructed to guarantee that a colored COIN symbol will land in the array in each free spin outcome. And the pay multipliers associated with the different COIN symbol colors may be increased in the bonus game such that the minimum pay multiplier is, for example, 2× (instead of the 1× pay multiplier associated with the green COIN symbol in the base game).

To communicate which game elements contribute to payouts and how they contribute, the game-logic circuitry may direct, the electronic display device to animate paying symbols, symbol positions, award amounts, application of the pay multiplier, and any modifications to the pay multiplier. The animation may, for example, include applying a border, pattern, color change, background change, watermark, or other distinguishing characteristic to the paying symbols and/or their symbol positions. To indicate that a landed COIN symbol causes the values of any ENVELOPE symbols to be awarded, animation may be used to create an apparent connection or link between the COIN symbol and each of the ENVELOPE symbols. For example, the COIN symbol and each of the ENVELOPE symbols may remain at their respective locations while an animation like lightning or other special effect extends between the COIN symbol and each of the ENVELOPE symbols. Alternatively, the COIN symbol may move or "float" from its landing position to each of the ENVELOPE symbols. Or, each of the ENVELOPE symbols may move or "float" from their respective landing positions to the COIN symbol. To indicate that a payout is multiplied by the pay multiplier in indicator 206, animation may be used to create an apparent connection or link between the pay multiplier and the payout. For example, the pay multiplier and the payout may remain at their respective locations while an animation like lightning or other special effect extends between the pay multiplier and the payout. Alternatively, the pay multiplier may move or "float" from indicator 206 to each payout amount shown elsewhere on the display device. When the floating multiplier reaches a payout amount, the payout amount is increased by the multiplier. Or, each payout amount may move or "float" to indicator 206 and be increased when it reaches indicator 206. To indicate that a landed COIN symbol modifies the pay multiplier in indicator 206 for the next spin(s), animation may be used at the conclusion of the current spin to create an apparent connection or link between the COIN symbol and indicator 206. For example, the COIN symbol and indicator 206 may remain at their respective locations while an animation like lightning or other special effect extends between the COIN symbol and indicator 206. Alternatively, the COIN symbol may move or "float" from its landing position to indicator 206. When the floating COIN symbol reaches indicator 206, the pay multiplier is changed to a value associated with the color of the COIN symbol.

As stated above, the green COIN symbol, the blue COIN symbol, and the red COIN symbol are associated with respective pay multipliers 1×, 8×, and 18×. In an alternative embodiment, each colored COIN symbol may be associated with a respective range of multipliers wherein a multiplier is randomly selected from the associated range. For example, the green COIN symbol may be associated with a low range (e.g., 1×-5×), the blue COIN symbol may be associated with a medium range (e.g., 6×-10×), and the red COIN may be associated with a high range (e.g., 11×-20×). In another embodiment, there is only one type of COIN symbol and, when the COIN symbol lands in the array, the game randomly selects a pay multiplier that persists through future spins until the COIN symbol re-appears in the array.

Instead of, or in addition to, using colors to represent different pay multipliers associated with the respective colored COIN symbols, each COIN symbol may bear its associated multiplier on its face or have a different shape, size, or other characteristic to represent different multipliers.

In the illustrated embodiment, COIN symbols only exist on the fifth reel and must land in the array in order to trigger the award of ENVELOPE values and a change in the pay multiplier to a value associated with the landed COIN symbol. In an alternative embodiment, COIN symbols may exist on one or more other reels and may likewise trigger these operations by landing in the array. If multiple COIN symbols land in the array, each COIN symbol may trigger the award of ENVELOPE values such that each ENVELOPE value is awarded multiple times. And if each COIN symbol is associated with a respective pay multiplier, the pay multiplier for the next spin may be changed to the sum or product of the pay multipliers associated with the multiple COIN symbols.

The COIN symbols may be associated with other modifiers besides, or in addition to, pay multipliers, including for example different credit amounts; different numbers of WILD symbols that are randomly distributed in the array after the reels have stopped; different numbers of WILD symbols (i.e., symbols that act as substitutes for standard symbols) that are added to the reel strips of the reels prior to stopping the reels; different numbers of free games/spins that do not require an additional wager; and so on.

In one embodiment, the symbol that triggers the award of ENVELOPE values may be different from the symbol that triggers a change in the pay multiplier for subsequent spins. For example, an OPEN ENVELOPE symbol may trigger the award of ENVELOPE values, while the green/blue/red COIN symbols trigger a change in the pay multiplier for subsequent spins without also awarding the ENVELOPE values.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A method of operating a gaming machine, the method comprising the operations of:

displaying, on an electronic display device, a plurality of symbol-bearing reels and an indicator, the indicator bearing a modifier; and generating, by game-logic circuitry using a random number generator, a series of spin outcomes, wherein for each spin outcome:

spinning and stopping the plurality of symbol-bearing reels to populate an array with landed symbols from the stopped reels;

in response to the landed symbols including a catalyst symbol:

displaying, on the electronic display device, an animation linking the catalyst symbol to each of any value-bearing symbols in the landed symbols, wherein the animation comprises an animation of the catalyst symbol moving from its original landing position in the array to the landing position of each of the one or more landed value-bearing symbols and, based on the modifier, modifying the value associated with each of the one or more landed value-bearing symbols;

awarding the modified values; and modifying the modifier for a subsequent spin outcome based on a type of the catalyst symbol, the type of the catalyst symbol being one of a plurality of possible types; and in response to the landed symbols including one or more value-bearing symbols but not the catalyst symbol:

not awarding values associated with the landed value-bearing symbols; and maintaining the modifier for the subsequent spin outcome.

2. The method of claim 1, further including, for each spin outcome, modifying payouts associated with winning symbol combinations in the array based on the modifier and awarding the modified payouts.

3. The method of claim 1, wherein the value-bearing symbols bear respective credit amounts.

4. The method of claim 1, wherein the modifier is a pay multiplier.

5. The method of claim 4, wherein the possible types of the catalyst symbol are associated with respective different values of the pay multiplier, wherein the modifying operation includes modifying value of the pay multiplier.

6. The method of claim 1, wherein the possible types of the catalyst symbol are represented by respective different colors of the catalyst symbol.

7. The method of claim 1, further comprising:

detecting, via at least one of one or more electronic input devices, a physical item associated with a monetary value that establishes a credit balance; and receiving, via at least one of the one or more electronic input devices, a cashout input that initiates a payout from the credit balance.

8. The method of claim 1, wherein in response to the symbols including the catalyst symbol but no value-bearing symbols, modifying the modifier for a subsequent spin outcome based on the type of the catalyst symbol.

9. A gaming system comprising:

a gaming machine including an electronic display device configured to display a plurality of symbol-bearing reels and an indicator, the indicator bearing a modifier; and game-logic circuitry configured to perform the operations of generating, using a random number generator, a series of spin outcomes, wherein for each spin outcome:

spinning and stopping the plurality of symbol-bearing reels to populate an array with landed symbols from the stopped reels;

in response to the landed symbols including one or more value-bearing symbols and a catalyst symbol:

displaying, on the electronic display device, an animation linking the catalyst symbol to each of the one or more value-bearing symbols in the landed symbols, wherein the animation comprises an animation of the catalyst symbol moving from its original landing position in the array to the landing position of each of the one or more landed value-bearing symbols and, based on the modifier, modifying the value associated with each of the one or more landed value-bearing symbols;

awarding the modified values; and modifying the modifier for a subsequent spin outcome based on a type of the catalyst symbol, the type of the catalyst symbol being one of a plurality of possible types; and in response to the symbols including one or more value-bearing symbols but not the catalyst symbol:

not awarding values associated with the value-bearing symbols; and maintaining the modifier for the subsequent spin outcome.

10. The gaming system of claim 9, wherein, for each spin outcome, the game-logic circuitry is configured to perform the operations of modifying payouts associated with winning symbol combinations in the array based on the modifier and awarding the modified payouts.

11. The gaming system of claim 9, wherein the value-bearing symbols bear respective credit amounts.

12. The gaining system of claim 9, wherein the modifier is a pay multiplier.

13. The gaming system of claim 12, wherein the possible types of the catalyst symbol are associated with respective different values of the pay multiplier, wherein the modifying operation includes modifying the value of the pay multiplier.

14. The gaming system of claim 9, wherein the possible types of the catalyst symbol are represented by respective different colors of the catalyst symbol.

15. The gaming system of claim 9, wherein the game-logic circuitry is configured to perform the operations of:

detecting, via at least one of one or more electronic input devices, a physical item associated with a monetary value that establishes a credit balance; and receiving, via at least one of the one or more electronic input devices, a cashout input that initiates a payout from the credit balance.

16. The gaming system of claim 9, wherein in response to the symbols including the catalyst symbol but no value-bearing symbols, the game-logic circuitry is configured to perform the operation of modifying the modifier for a subsequent spin outcome based on the type of the catalyst symbol.

17. A method of operating a gaming machine, the method comprising the operations of:

displaying, on an electronic display device, a plurality of symbol-bearing reels and an indicator, the indicator bearing a pay multiplier; and generating, by game-logic circuitry using a random number generator, a series of spin outcomes, wherein for each spin outcome:

spinning and stopping the plurality of symbol-bearing reels to populate an array with landed symbols from the stopped reels;

awarding payouts for winning symbol combinations in the array multiplied by the pay multiplier;

in response to the landed symbols including one or more value-bearing symbols and a catalyst symbol:

displaying, on the electronic display device, an animation linking the catalyst symbol to each of the one or more value-bearing symbols in the landed symbols, wherein the animation comprises an animation of the catalyst symbol moving from its original landing position in the army to the landing position of each of the one or more landed value-bearing symbols;

awarding values associated with the one or more value-bearing symbols in the landed symbols multiplied by the pay multiplier; and modifying the pay multiplier for a subsequent spin outcome based on a type of the catalyst symbol, the type of the catalyst symbol being one of a plurality of possible types; and in response to the symbols including one or more value-bearing symbols but not the catalyst symbol:

not awarding values associated with the value-bearing symbols; and maintaining the pay multiplier for the subsequent spin outcome.

18. The method of claim 17, wherein the possible types of the catalyst symbol are associated with respective different values of the pay multiplier, wherein the modifying operation includes modifying the value of the pay multiplier.

19. The method of claim 17, wherein in response to the symbols including the catalyst symbol but no value-bearing symbols, modifying the pay multiplier for a subsequent spin outcome based on the type of the catalyst symbol.

* * * * *